US011502426B2

(12) United States Patent
Sugimoto et al.

(10) Patent No.: US 11,502,426 B2
(45) Date of Patent: Nov. 15, 2022

(54) ANTENNA DEVICE

(71) Applicant: DENSO CORPORATION, Kariya (JP)

(72) Inventors: Yuji Sugimoto, Kariya (JP); Shiro Koide, Kariya (JP)

(73) Assignee: DENSO CORPORATION, Kariya (JP)

( * ) Notice: Subject to any disclaimer, the term of this patent is extended or adjusted under 35 U.S.C. 154(b) by 40 days.

(21) Appl. No.: 17/132,698

(22) Filed: Dec. 23, 2020

(65) Prior Publication Data

US 2021/0151902 A1 May 20, 2021

Related U.S. Application Data

(63) Continuation of application No. PCT/JP2019/026327, filed on Jul. 2, 2019.

(30) Foreign Application Priority Data

Jul. 5, 2018 (JP) ..... JP2018-128250

(51) Int. Cl.
*H01Q 1/32* (2006.01)
*H01Q 21/24* (2006.01)
(Continued)

(52) U.S. Cl.
CPC ..... *H01Q 21/24* (2013.01); *H01Q 1/32* (2013.01); *H01Q 5/35* (2015.01); *H01Q 7/00* (2013.01); *H01Q 9/42* (2013.01)

(58) Field of Classification Search
CPC ..... H01Q 21/24; H01Q 1/32; H01Q 5/35; H01Q 7/00; H01Q 9/42; H01Q 1/3275; H01Q 5/307; H01Q 9/26; H01Q 21/28
See application file for complete search history.

(56) References Cited

U.S. PATENT DOCUMENTS

2007/0273527 A1 11/2007 Yamagajo et al.
2018/0198193 A1 7/2018 Wada et al.
2019/0273311 A1 9/2019 Sampo et al.

FOREIGN PATENT DOCUMENTS

JP 2002-135028 A 5/2002
JP 2007318323 A 12/2007
(Continued)

OTHER PUBLICATIONS

Machine Translation of Lee et al. KR-2011023618-A (Year: 2011).*
(Continued)

*Primary Examiner* — Dimary S Lopez Cruz
*Assistant Examiner* — Michael M Bouizza
(74) *Attorney, Agent, or Firm* — Harness, Dickey & Pierce, P.L.C.

(57) ABSTRACT

An antenna device according to an aspect of the present disclosure includes a zeroth-order resonant antenna and a first-order resonant antenna. The zeroth-order resonant antenna includes a base plate, a platy radiation element, and a connection conductor connecting the base plate and the platy radiation element. The zeroth-order resonant antenna is configured to transmit and/or receive a first linearly polarized radio wave in all directions perpendicular to the first linearly polarized radio wave by zeroth order resonance. The first-order resonant antenna includes the base plate shared with the zeroth-order resonant antenna, and a first radiation element located on the same plane as the base plate. The first-order resonant antenna is configured to transmit and/or receive a second linearly polarized radio wave perpendicular to the first linearly polarized radio wave by first order resonance.

8 Claims, 4 Drawing Sheets

(51) Int. Cl.

| | |
|---|---|
| ***H01Q 5/35*** | (2015.01) |
| ***H01Q 7/00*** | (2006.01) |
| ***H01Q 9/42*** | (2006.01) |

(56) References Cited

FOREIGN PATENT DOCUMENTS

| | | | | |
|---|---|---|---|---|
| JP | 2015046827 | A | | 3/2015 |
| JP | 2017022497 | A | | 1/2017 |
| JP | 2017187379 | A | | 10/2017 |
| KR | 2011023618 | A | * | 3/2011 |
| WO | WO-2018110671 | A1 | | 6/2018 |

OTHER PUBLICATIONS

A. Lai et al., "Infinite Wavelength Resonant Antennas With Monopolar Radiation Pattern Based on Periodic Structures," IEEE Transaction on Antennas and Propagation, vol. 55, No. 3, Mar. 2007, pp. 868-876.

* cited by examiner

ANTENNA DEVICE

CROSS REFERENCE TO RELATED APPLICATION

The present application is a continuation application of International Patent Application No. PCT/JP2019/026327 filed on Jul. 2, 2019, which designated the U.S. and claims the benefit of priority from Japanese Patent Application No. 2018-128250 filed on Jul. 5, 2018. The entire disclosures of all of the above applications are incorporated herein by reference.

TECHNICAL FIELD

The present disclosure relates to techniques for transmitting and/or receiving two different polarized waves.

BACKGROUND

A technique is known, in which a horizontally polarized antenna and a vertically polarized antenna are mounted on a vehicle and they are spaced from each other. Each of the horizontally polarized antenna and the vertically polarized antenna is a monopole antenna.

SUMMARY

An antenna device according to an aspect of the present disclosure includes a zeroth-order resonant antenna and a first-order resonant antenna.

The zeroth-order resonant antenna includes a base plate, a platy radiation element, and a connection conductor. The platy radiation element is spaced from the base plate and faces the base plate. The platy radiation element is configured to be supplied with power. The connection conductor is a conductor electrically connecting the platy radiation element and the base plate.

The zeroth-order resonant antenna is configured to transmit and/or receive a first linearly polarized radio wave in all directions perpendicular to the first linearly polarized radio wave by zeroth order resonance.

The first-order resonant antenna includes the base plate shared with the zeroth-order resonant antenna, and a first radiation element. The first radiation element is located on the same plane as the base plate and is configured to be supplied with power.

The first-order resonant antenna is configured to transmit and/or receive a second linearly polarized radio wave perpendicular to the first linearly polarized radio wave by first order resonance.

EMBODIMENTS

As a result of studies by the inventors, the inventors found that the size of the system including two monopole antennas may be increased and man-hours required for mounting the system on the vehicle may be increased when the two monopole antennas corresponding to each of two orthogonal polarized waves are arranged to be spaced from each other.

Exemplary embodiments of the present disclosure will be described below with reference to the drawings.

1. First Embodiment

(1-1) Example of how to Mount Antenna Device

Figure 1:
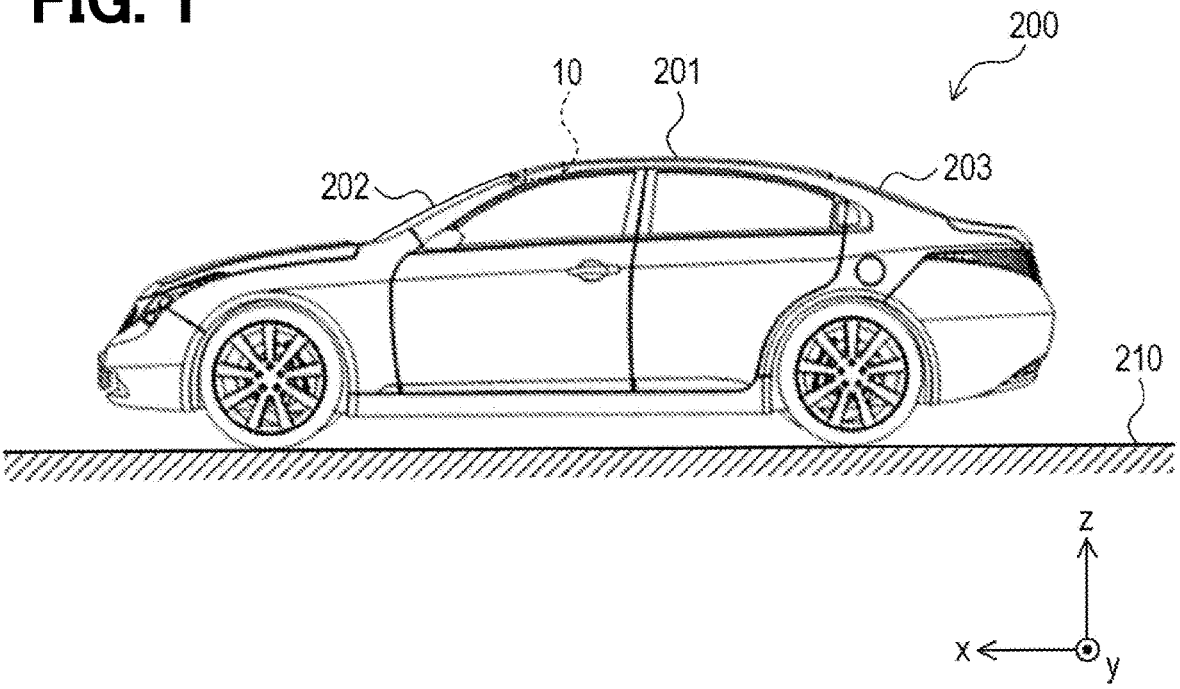
FIG. 1 is a side view of a vehicle.

As shown in FIG. 1, a vehicle 200 includes a roof 201, a windshield 202, and a rear window 203. The vehicle 200 travels on a ground 210.

The vehicle 200 is equipped with an antenna device 10. Specifically, the antenna device 10 is located in the vicinity of the windshield 202 on the ceiling (that is, the reverse side of the roof 201).

The antenna device 10 is configured to separately transmit and receive two polarized radio waves orthogonal to each other. Specifically, in the present embodiment, the antenna device 10 is mounted on the vehicle 200 to transmit and receive vertically polarized radio wave and horizontally polarized radio wave.

The antenna device 10 may be embedded in the ceiling such that occupants cannot see the antenna device 10, or may be exposed in a passenger compartment such that occupants can see the antenna device 10.

(1-2) Configurations of the Antenna Device

Figure 2:
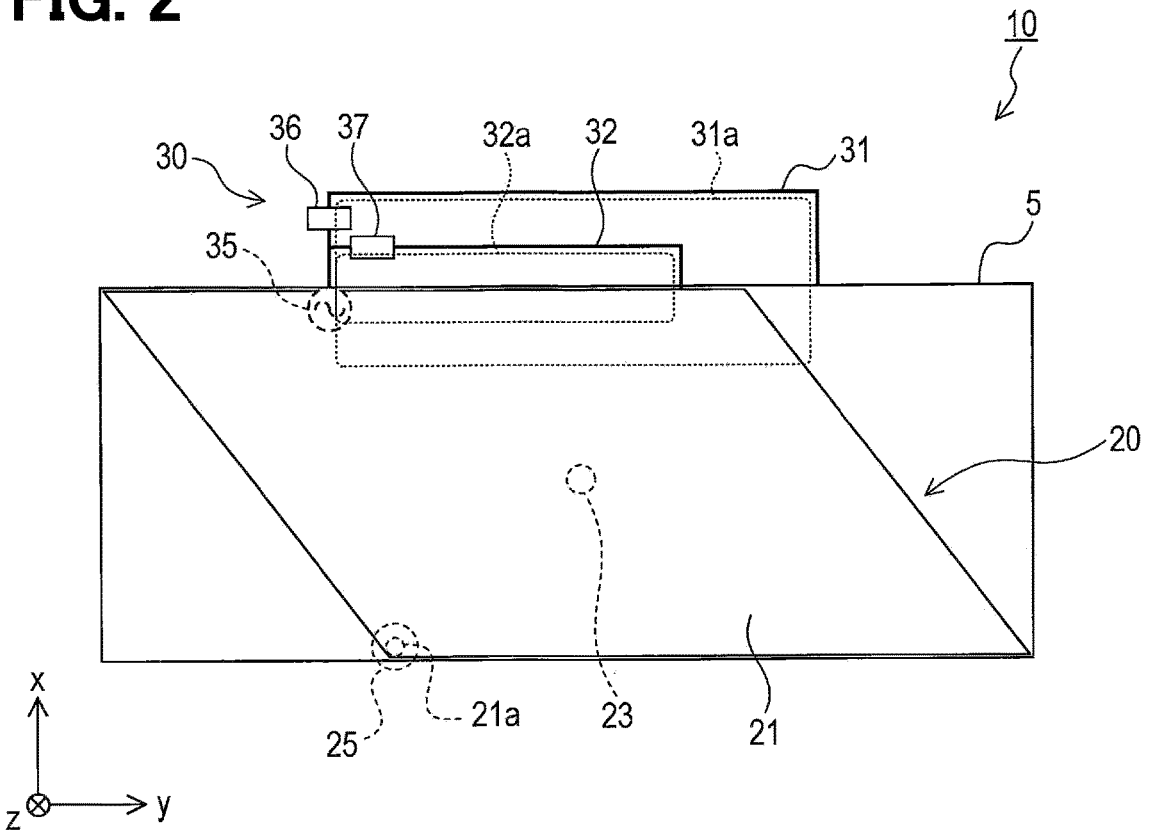
FIG. 2 is a plan view of an antenna device according to a first embodiment.
Figure 3:
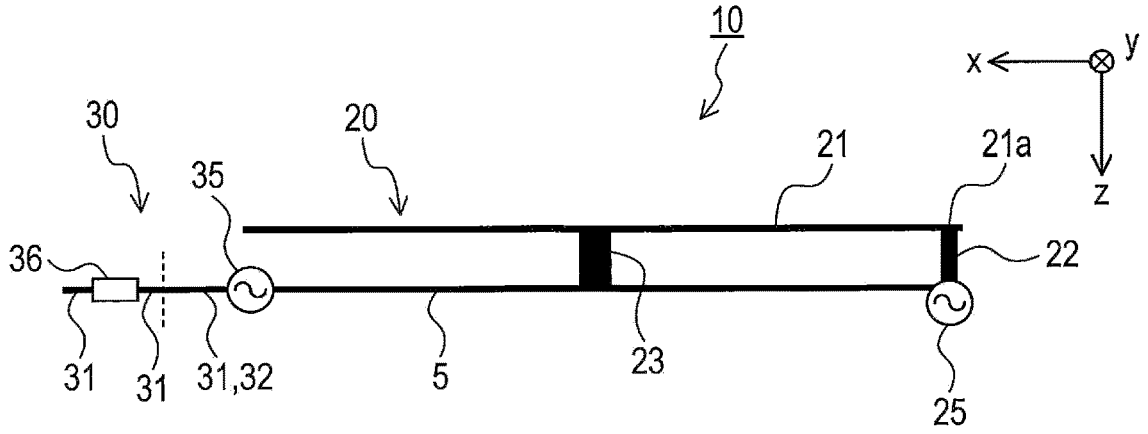
FIG. 3 is a side view of the antenna device according to the first embodiment.
Figure 4:
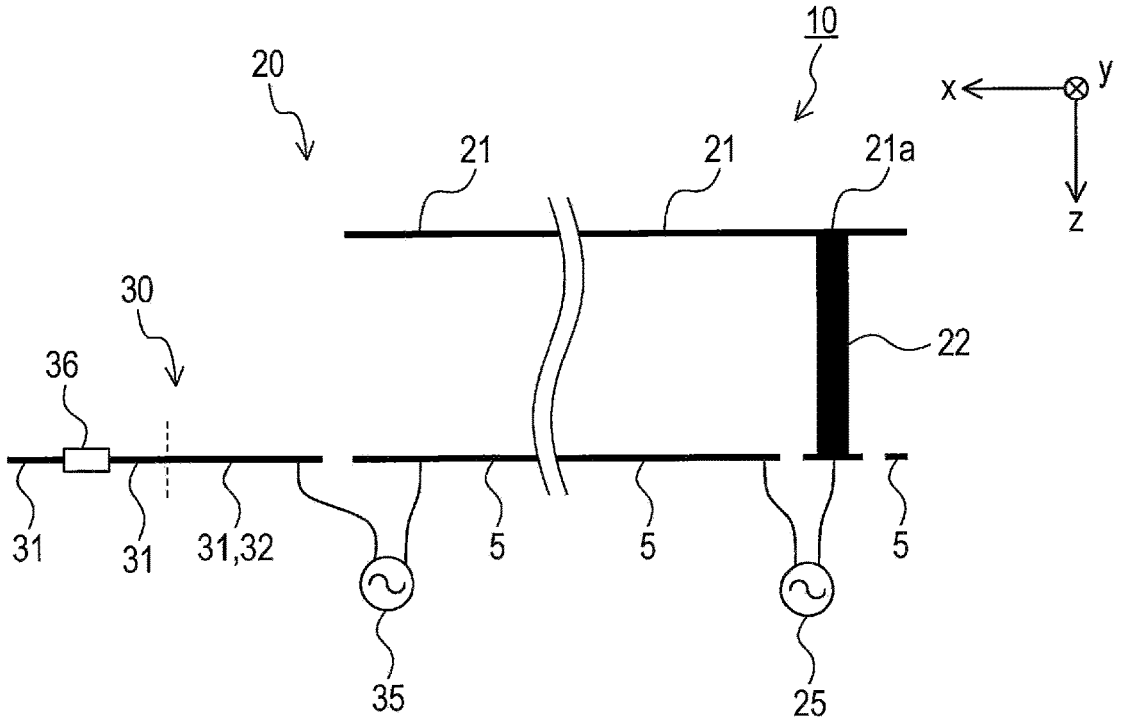
FIG. 4 is an enlarged view of a part of one side of the antenna device according to the first embodiment.

The antenna device 10 shown in FIGS. 2-4 includes a zeroth-order resonant antenna 20, a first-order resonant antenna 30, and two power supply circuits 25, 35. The power supply circuit 25 is connected with the zeroth-order resonant antenna 20 to supply power to the zeroth-order resonant antenna 20. The power supply circuit 35 is connected with the first-order resonant antenna 30 to supply power to the first-order resonant antenna 30.

The zeroth-order resonant antenna 20 includes a base plate 5, a platy radiation element 21, and a connection conductor 23.

The base plate 5 is a platy conductor having a rectangular shape, for example. The base plate 5 functions as a ground for the zeroth-order resonant antenna 20. The base plate 5 also functions as a ground for the first-order resonant antenna 30.

The platy radiation element 21 is a platy conductor. The platy radiation element 21 is spaced from the base plate 5 in a direction perpendicular to a plate surface of the base plate 5 and faces the base plate 5. The platy radiation element 21 has a parallelogram shape as shown in FIG. 2, for example, and is arranged parallel to the base plate 5.

An x-direction, a y-direction, and a z-direction are defined with respect to the antenna device 10. As shown in FIGS. 2-4, the z-direction is a direction perpendicular to the plate surface of the base plate 5, and the platy radiation element 21 faces the base plate 5 along the z-direction. As shown in FIGS. 2-4, the x-direction is a direction parallel to the plate surface of the base plate 5 and perpendicular to a longer side of the base plate 5. The x-direction is the upward direction in FIG. 2 and perpendicular to the z-direction. As shown in FIGS. 2-4, the y-direction is a direction parallel to the plate surface of the base plate 5 and perpendicular to a shorter side of the base plate 5. The y-direction is the right direction in FIG. 2 and perpendicular to both the x-direction and the z-direction. These three directions are shown in each of FIGS. 1-7 in the directions corresponding to the drawings.

The platy radiation element 21 is arranged such that the entire plate surface of the platy radiation element 21 faces the base plate 5 in the z-direction. The length of the platy radiation element 21 in the x-direction is substantially the same as the length of the base plate 5 in the x-direction. The length of the platy radiation element 21 in the y-direction is substantially the same as the length of the base plate 5 in the y-direction.

The connection conductor 23 electrically connects (that is, shunts) the platy radiation element 21 and the base plate 5. A first end of the connection conductor 23 is connected to a substantially center portion of the base plate 5, and a second end of the connection conductor 23 is connected to a substantially center portion of the platy radiation element 21. The connection conductor 23 has a circular column shape whose central axis is parallel to the z-direction, for example.

In the present embodiment, there is no tangible objects other than the connection conductor 23 between the platy radiation element 21 and the base plate 5. That is, an air layer exists between the platy radiation element 21 and the base plate 5. However, a tangible objects (for example, dielectric such as resin) other than the connection conductor 23 may be disposed between the platy radiation element 21 and the base plate 5.

The way to fix the platy radiation element 21 to the base plate 5 is not limited. For example, the platy radiation element 21 may be fixed to the base plate 5 only by the connection conductor 23. Further, the platy radiation element 21 may be supported by at least one insulating member such as a spacer made of resin.

The zeroth-order resonant antenna 20 is connected with the power supply circuit 25 and is fed from the power supply circuit 25. Specifically, the power supply circuit 25 is connected with the platy radiation element 21 and the base plate 5 as shown in FIG. 4. More specifically, the power supply circuit 25 is connected with the platy radiation element 21 through a power supply conductor 22.

The platy radiation element 21 has a parallelogram shape, in which interior angles at two vertices are acute angles and interior angles at the other two vertices are obtuse angles. A feed point 21*a* is provided in the vicinity of or at one vertex at which the interior angle is obtuse angle, as shown in FIGS. 2-4. The power supply conductor 22 is connected to the feed point 21*a* as shown in FIGS. 3, 4. The "vicinity" of the vertex may be a position along a part of the outer edge of the platy radiation element 21 in a predetermined area. The position may be on the outer edge. The position may be spaced from the outer edge by a predetermined distance or less. The outer edge in the predetermined area may be: a part of one side extending from the vertex, the part between the vertex and a first predetermined point closer to the vertex than the midpoint of the side; and a part of the other side extending from the vertex, the part between the vertex and a second predetermined point closer to the midpoint of the side. The closer the position of the feed point 21*a* is to the vertex at which the interior angle is obtuse angle, the wider the bandwidth of radio wave in which the antenna device can transmit and receive is.

The power supply conductor 22 is a conductor for connecting the power supply circuit 25 and the platy radiation element 21. The power supply conductor 22 has a circular column shape whose central axis is parallel to the z-direction, for example. A first end of the power supply conductor 22 is connected to the feed point 21*a* of the platy radiation element 21, and a second end of the power supply conductor 22 is connected to the power supply circuit 25. The power supply circuit 25 is configured to perform unbalanced feed to the zeroth-order resonant antenna 20.

The zeroth-order resonant antenna 20 has a structure in which the platy radiation element 21 and the base plate 5 facing each other are connected through the connection conductor 23. This structure is the same as the basic structure of so-called metamaterials. That is, the zeroth-order resonant antenna 20 is a kind of metamaterial. A metamaterial is a substance or structure that realizes peculiar radio wave propagation that may be difficult to realize only by the characteristics inherent to materials.

The zeroth-order resonant antenna 20 performs zeroth order resonance (that is, operates in the zeroth order resonance mode) according to the frequency of the supplied power. When the zeroth-order resonant antenna 20 performs zeroth order resonance, the electric field in the z-direction is uniformly generated between the platy radiation element 21 and the base plate 5. Due to this electric field, a first linearly polarized radio wave is transmitted (radiated) from the outer edge of the platy radiation element 21 in all directions perpendicular to the first linearly polarized wave.

The first linearly polarized wave is along the z-direction in the present embodiment. Accordingly, the first linearly polarized radio wave is transmitted from the zeroth-order resonant antenna 20 in all directions parallel to the x-y plane. Further, the zeroth-order resonant antenna 20 receives the first linearly polarized radio wave arriving from the outside of the antenna device 10 by the zeroth order resonance. The zeroth-order resonant antenna 20 of the present embodiment is configured to receive the first linearly polarized radio wave arriving from all directions parallel to the x-y plane.

The frequency at which the zeroth order resonance occurs in the zeroth-order resonant antenna 20 (hereinafter, referred to as a zeroth order resonance frequency f0) is determined mainly by a capacitor component composed of the platy radiation element 21 and the base plate 5 and an inductance component of the platy radiation element 21 and the connection conductor 23. The zeroth-order resonant antenna 20 is configured to adequately transmit and receive radio waves in a predetermined band including the zeroth order resonance frequency f0.

The shape and size of the platy radiation element 21, the size of the connection conductor 23, the position of the feed point 21*a* in the platy radiation element 21, and the location of the platy radiation element 21 to which the connection conductor 23 is connected are determined such that the zeroth order resonance in the zeroth-order resonant antenna 20 occurs at a desired operating frequency. In the present embodiment, the zeroth order resonance frequency f0 of the zeroth-order resonant antenna 20 may be 850 MHz, for example.

The distance between the base plate 5 and the platy radiation element 21 in the z-direction may be about 1-2% of the zeroth order resonance frequency f0, for example. The lengths of the base plate 5 and the platy radiation element 21 in the y-direction may be 10-20% of the zeroth order resonance frequency f0, for example.

Next, the first-order resonant antenna 30 will be described. The first-order resonant antenna 30 is configured to transmit and receive a second linearly polarized radio wave perpendicular to the first linearly polarized wave (that is, a polarized wave parallel to the x-y plane) by performing first order resonance according to the supplied power.

The first-order resonant antenna 30 includes the base plate 5 shared with the zeroth-order resonant antenna 20, the first radiation element 31, and a second radiation element 32. The first radiation element 31 and the second radiation element 32 are located on the same plane as the base plate 5 and supplied with power from the power supply circuit 35.

The first radiation element 31 has a substantially linear and substantially U-shape, for example. A first end of the first radiation element 31 is connected to the base plate 5, and a second end of the first radiation element 31 is connected to the power supply circuit 35. A first matching circuit 36 for adjusting the impedance of the first radiation element 31 is located at a part of the first radiation element 31 close to the second end.

With such a configuration, a first closed loop 31*a* is formed by the first radiation element 31 and the base plate 5. That is, the first-order resonant antenna 30 includes an antenna (hereinafter, referred to as a first loop antenna) that is operated by a current flowing through the first closed loop 31*a*. The first loop antenna is configured to transmit and receive the second linearly polarized radio wave.

The frequency at which the first order resonance occurs in the first loop antenna is referred to as a first resonance frequency f1. The first resonance frequency f1 may be 850 MHz, for example.

The second radiation element 32 is located inside the region surrounded by the first radiation element 31 and the base plate 5. The second radiation element 32 has a substantially linear and substantially U-shape, for example. A first end of the second radiation element 32 is connected to the base plate 5, and a second end of the second radiation element 32 is connected to the power supply circuit 35. A part of the second radiation element 32 extending from the second end in the x-direction is shared with the first radiation element 31. However, it is not essential that a part of the second radiation element 32 is shared with the first radiation element 31. The second radiation element 32 may be provided separately from the first radiation element 31 without including a part shared with the first radiation element 31.

A second matching circuit 37 for adjusting the impedance of the second radiation element 32 is located in the vicinity of the second end of the second radiation element 32 (but closer to the first end than the part shared with the first radiation element 31 is to).

With such a configuration, a second closed loop 32*a* is formed by the second radiation element 32 and the base plate 5. That is, the first-order resonant antenna 30 includes an antenna (hereinafter, referred to as a second loop antenna) that is operated by a current flowing through the second closed loop 32*a* in addition to the above-mentioned first loop antenna. The second loop antenna is configured to transmit and receive the second linearly polarized radio wave. The frequency at which the first order resonance occurs in the second loop antenna is referred to as a second resonance frequency f2. The second resonance frequency f2 may be 1.7 GHz, for example.

The first radiation element 31 and the second radiation element 32 do not face the platy radiation element 21 in the z-direction. A part of the first radiation element 31 may face the platy radiation element 21 in the z-direction. A part of the second radiation element 32 may face the platy radiation element 21 in the z-direction.

The power supply circuit 35 is configured to perform unbalanced feed to both the first loop antenna and the second loop antenna. The first-order resonant antenna 30 is configured to adequately transmit and receive radio waves in a predetermined band including the first resonance frequency f1 and radio waves in a predetermined band including the second resonance frequency f2.

In the present embodiment, the antenna device 10 is mounted on the vehicle 200 to transmit vertically polarized radio waves from the zeroth-order resonant antenna 20 and transmit horizontally polarized radio waves from the first-order resonant antenna 30. That is, the antenna device 10 is arranged in the vehicle 200 such that the first linearly polarized wave of the zeroth-order resonant antenna 20 corresponds the vertically polarized waves and the second linearly polarized wave of the first-order resonant antenna 30 corresponds to the horizontally polarized waves. That is, the first linearly polarized wave of the zeroth-order resonant antenna 20 is perpendicular to the ground 210, and the second linearly polarized wave of the first-order resonant antenna 30 is parallel to the ground 210. Specifically, the antenna device 10 is mounted on the vehicle 200 such that the base plate 5 is parallel to the ground 210.

The antenna device 10 is arranged in the vehicle 200, such that a longer side of the base plate 5 along which the first-order resonant antenna 30 is arranged faces the front of the vehicle 200 and is perpendicular to a direction in which the vehicle 200 travels.

The antenna device 10 is mounted on the ceiling of the vehicle 200 such that the platy radiation element 21 is located closer to the ground 210 than the base plate 5. That is, the antenna device 10 is mounted on the ceiling of the vehicle 200 such that the base plate 5 is located between the platy radiation element 21 and the roof 201. The roof 201 is a conductor. The base plate 5 is electrically connected with the roof 201.

(1-3) Effects of First Embodiment

According to the first embodiment described above, the following effects (1a) to (1h) are obtained.

(1a) In the antenna device 10, one base plate 5 is shared by the zeroth-order resonant antenna 20 and the first-order resonant antenna 30. Further, the zeroth-order resonant antenna 20 is so-called metamaterial operating in the zeroth order resonance mode, and accordingly the size of the zeroth-order resonant antenna 20 in the direction of the first linearly polarized wave can be smaller than the antennas such as monopole antenna operating in the first order resonance mode.

According to the antenna device 10, the antenna device configured to transmit and receive two orthogonal polarized waves can be smaller.

In general, the directivity of a patch antenna configured to radiate vertically polarized waves has a main lobe perpendicular to a conductor patch. Accordingly, with such a patch antenna, it may be difficult to radiate vertically polarized radio waves in all directions orthogonal to the plane of polarization.

In contrast, according to the antenna device 10 of the present embodiment, the zeroth-order resonant antenna 20 that functions as metamaterial (that is, operates in the zeroth order resonance mode) is used as an antenna for the vertically polarized waves. The vertically polarized radio waves are adequately radiated in all directions orthogonal to the plane of polarization from the zeroth-order resonant antenna 20. The size of the zeroth-order resonant antenna 20 in the vertical direction can be smaller than linear antennas such as monopole antenna.

(1b) In the present embodiment, the antenna device 10 is arranged in the vehicle 200 such that the zeroth-order resonant antenna 20 corresponds to the vertically polarized wave and the first-order resonant antenna 30 corresponds to the horizontally polarized wave. Accordingly, both the vertically polarized waves and the horizontally polarized waves can be adequately transmitted and received respectively.

(1c) The antenna device 10 of the present embodiment is provided in the ceiling of the passenger compartment of the vehicle 200. Accordingly, the communication speed can be improved as compared with a system in which the antenna for the vertically polarized waves is provided on the roof and the antenna for the horizontally polarized waves is provided in the instrument panel.

(1d) The feed point 21*a* of the platy radiation element 21 is located in the vicinity of or at one vertex at which the interior angle is obtuse angle. Accordingly, the bandwidth can be widened as compared with the case where the feed point 21*a* is located at a vertex at which the interior angle is acute angle.

(1e) The first-order resonant antenna 30 includes two closed loops, i.e. the first closed loop 31*a* and the second closed loop 32*a*. Accordingly, the bandwidth can be widened as compared with the case where only one closed loop is provided.

(1f) The first closed loop 31*a* is not formed only by the first radiation element 31 but is formed by the first radiation element 31 and the base plate 5. That is, the base plate 5 is a part of the first closed loop 31*a*. The second closed loop 32*a* is not formed only by the second radiation element 32 but is formed by the second radiation element 32 and the base plate 5. That is, the base plate 5 is a part of the second closed loop 32*a*. Since the closed loops 31*a*, 32*a* are formed with the base plate 5, the first-order resonant antenna 30 can be small.

(1g) The first radiation element 31 and the second radiation element 32 do not face the platy radiation element 21 in the z-direction. Accordingly, changes in impedance and directivity of the antennas 20, 30 caused by the platy radiation element 21 being close to the first radiation element 31 and the second radiation element 32 can be suppressed. Accordingly, the antennas 20, 30 can adequately perform independent operations (that is, operations without influence of other antennas).

(1h) The feed point 21*a* of the platy radiation element 21 is located around a side of the platy radiation element 21 opposite to the other side along which the first-order resonant antenna 30 is located. Since the feed point 21*a* of the platy radiation element 21 is spaced from the feed point of the first-order resonant antenna 30, the zeroth-order resonant antenna 20 can be well isolated from the first-order resonant antenna 30.

Here, it is assumed that an imaginary plane is parallel to the plate surface of the base plate and crosses the base plate. In this situation, "the first radiation element is located on the same plane as the base plate" means that the first radiation element is located along the imaginary plane and the imaginary plane crosses all over the first radiation element.

According to such a configuration, one base plate is shared by the zeroth-order resonant antenna corresponding to the first linearly polarized wave and the first-order resonant antenna corresponding to the second linearly polarized wave. Further, the zeroth-order resonant antenna is configured as so-called metamaterial that operates in zeroth order resonance mode. Accordingly, the length of the zeroth-order resonant antenna in a direction of the first linearly polarized wave can be smaller than antennas such as monopole antenna that operates in first order resonance mode. Accordingly, the antenna device configured to transmit and/or receive two orthogonal polarized waves can be smaller.

It should be noted that "perpendicular" described above is not limited to being at right angle in a strict sense as far as the similar effect can be attained. It should be noted that "on the same plane" described above is not limited to being on strictly the same plane as far as the similar effect can be attained. For example, a part of the first radiation element may be separated from the above-described imaginary plane.

2. Second Embodiment

Figure 5:
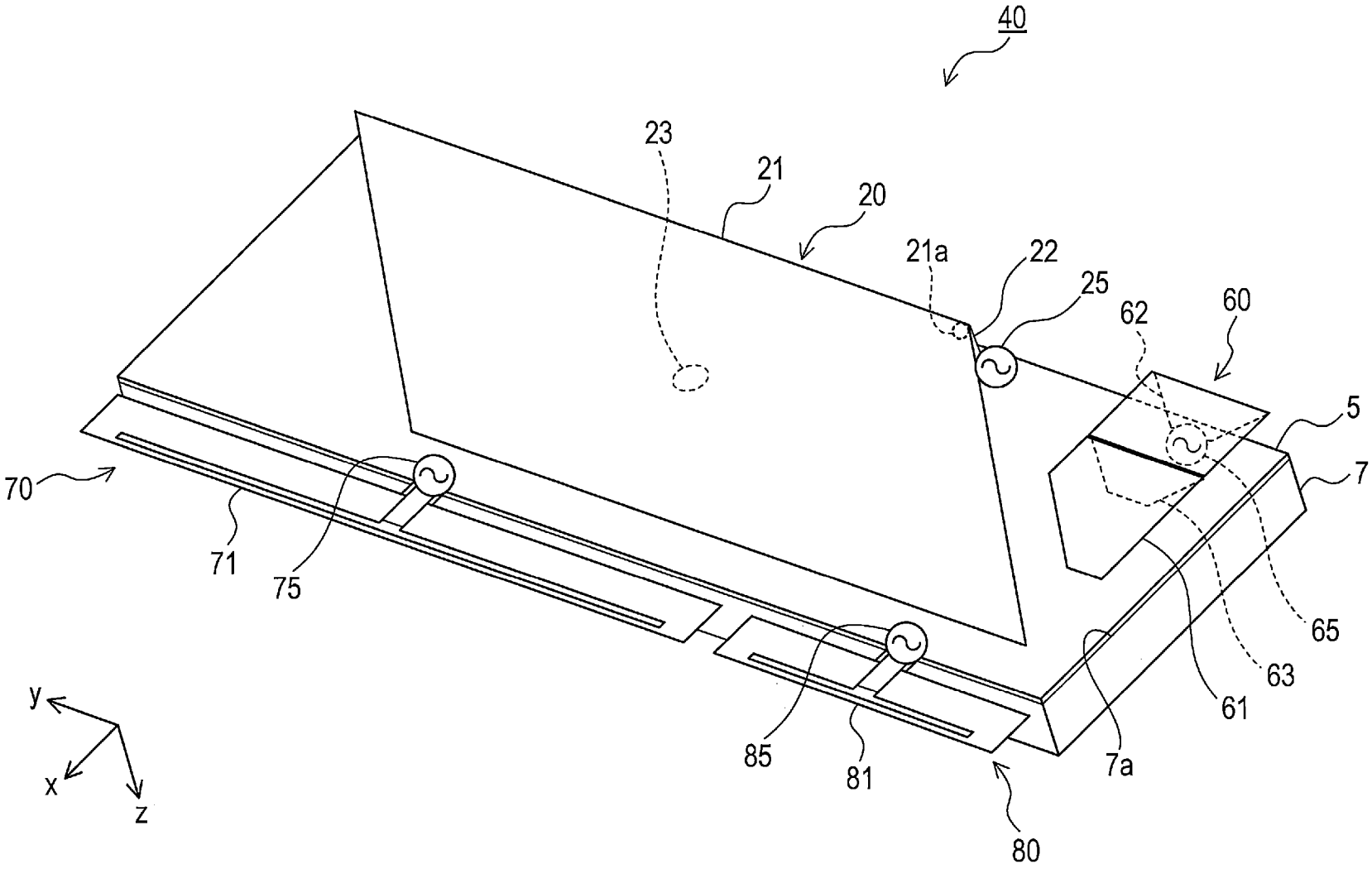
FIG. 5 is a perspective view of an antenna device according to a second embodiment.
Figure 6:
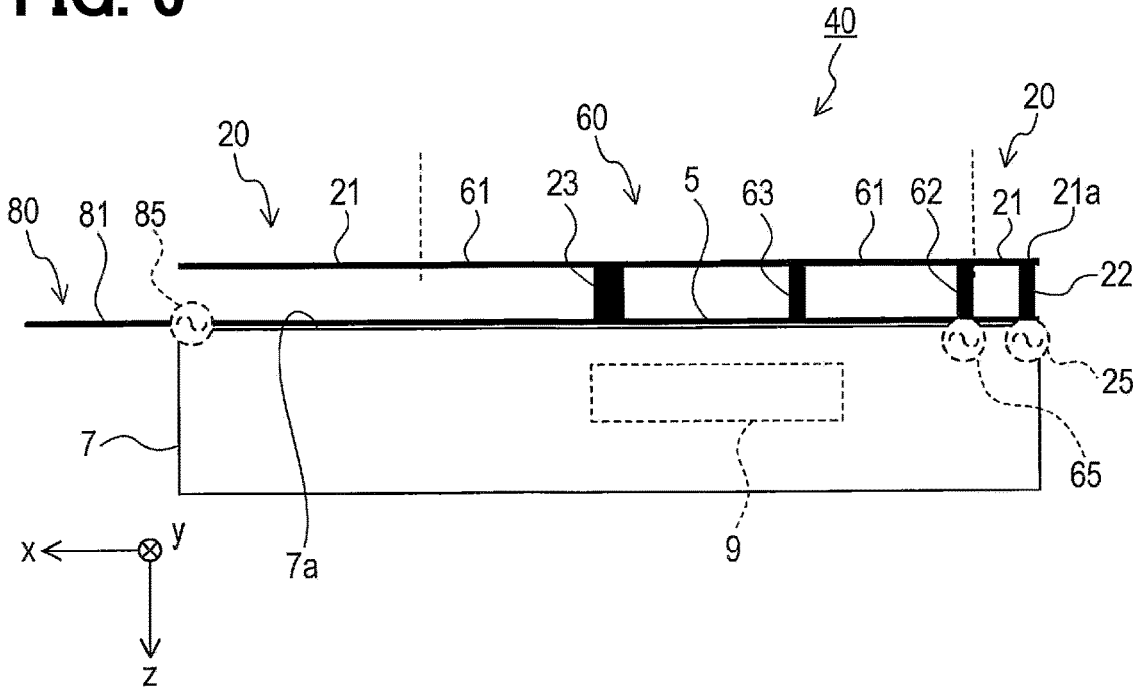
FIG. 6 is a side view of the antenna device according to the second embodiment.

As shown in FIGS. 5-6, the antenna device 40 of the second embodiment includes a shielding case 7, the base plate 5, the zeroth-order resonant antenna 20, a first first-order resonant antenna 70, a second first-order resonant antenna 80, and a third first-order resonant antenna 60.

The base plate 5 and the zeroth-order resonant antenna 20 are the same as the base plate 5 and the zeroth-order resonant antenna 20 of the first embodiment shown in FIGS. 2-4. See the above-described explanations.

The shielding case 7 is a hollow casing having a substantially rectangular parallelepiped shape. The shielding case 7 is made from aluminum, for example. However, the shielding case 7 may be made from a conductor other than aluminum. Further, the entire shielding case 7 does not have to be a conductor, and a part of the shielding case 7 may be an insulator.

The base plate 5 is located outside the shielding case 7 and placed on a base plate placing surface 7*a* which is one side of the shielding case 7. The base plate placing surface 7*a* is a conductor, and the base plate 5 is in contact with the base plate placing surface 7*a* partially or entirely. That is, the base plate 5 is electrically connected with the base plate placing surface 7*a*.

As shown in FIG. 6, a power supply unit 9 is house in the shielding case 7. The power supply unit 9 includes the power supply circuit 25 of the zeroth-order resonant antenna 20 and other power supply circuits 65, 75, 85. That is, the power supply circuits 25, 65, 75, 85 are included in the power supply unit 9 and are configured to supply power to corresponding radiation element. Accordingly, transmission lines (e.g. coaxial cables) are provided between the power supply unit 9 and the antennas 20, 60, 70, 80 of the antenna device 40 for connecting the antennas 20, 60, 70, 80 to the corresponding power supply circuit. In FIGS. 5, 6, the power supply circuits 25, 65, 75, 85 are shown in the vicinity of the corresponding radiation elements for convenience of explanation.

In the antenna device 10 of the first embodiment, the power supply circuits 25, 35 may be housed in a power supply unit (not shown).

The first first-order resonant antenna 70 includes the base plate 5 shared with the zeroth-order resonant antenna 20, and the radiation element 71. The radiation element 71 has a rectangular loop shape and is located on the same plane as the base plate 5. The radiation element 71 is connected with the power supply circuit 75. The power supply circuit 75 is configured to perform balanced feeding to the radiation element 71.

The first first-order resonant antenna 70 is configured to transmit and receive a second linearly polarized radio wave perpendicular to the first linearly polarized wave (that is, polarized waves parallel to the x-y plane) by first order resonance.

The resonance frequency f11 of the first first-order resonant antenna 70 is 850 MHz, for example. The first first-order resonant antenna 70 is configured to adequately transmit and receive radio waves in a predetermined band including the resonance frequency f11.

The second first-order resonant antenna 80 includes the base plate 5 shared with the zeroth-order resonant antenna 20, and the radiation element 81. The radiation element 81 has a rectangular loop shape and is located on the same plane as the base plate 5. The radiation element 81 is connected with the power supply circuit 85. The power supply circuit 85 is configured to perform balanced feeding to the radiation element 81.

The second first-order resonant antenna 80 is configured to transmit and receive third linearly polarized radio waves perpendicular to the first linearly polarized wave (that is, polarized waves parallel to the x-y plane) by first order resonance.

The resonance frequency f12 of the second first-order resonant antenna 80 is 1.7 GHz, for example. The second first-order resonant antenna 80 is configured to adequately transmit and receive radio waves in a predetermined band including the resonance frequency f12.

The third first-order resonant antenna 60 is an inverted-F antenna having a platy shape. The third first-order resonant antenna 60 includes the base plate 5 shared with the zeroth-order resonant antenna 20, the radiation element 61, the power supply conductor 62, and the connection conductor 63. The third first-order resonant antenna 60 extends from the base plate 5 in the z-direction.

The third first-order resonant antenna 60 is configured to transmit and receive the first linearly polarized radio wave by first order resonance according to the supplied power as in the zeroth-order resonant antenna 20.

The resonance frequency f13 of the third first-order resonant antenna 60 is 2.1 MHz, for example. The third first-order resonant antenna 60 is configured to adequately transmit and receive radio waves in a predetermined band including the resonance frequency f13.

The antenna device 40 may be mounted on the vehicle 200 in the same manner as the antenna device 10 of the first embodiment. That is, the antenna device 40 may be mounted on the vehicle 200 such that: the base plate 5 is parallel to the ground 210; one of the longer sides of the base plate 5 along which the first first-order resonant antenna 70 is provided faces the front side of the vehicle 200; the one of the longer sides is perpendicular to the direction in which the vehicle 200 travels; and the platy radiation element 21 is closer to the ground than the base plate 5 is to.

That is, the antenna device 40 may be mounted on the vehicle 200 such that: the first linearly polarized wave of the zeroth-order resonant antenna 20 corresponds to the vertically polarized waves; and the second linearly polarized wave of the first first-order resonant antenna 70 and the third linearly polarized wave of the second first-order resonant antenna 80 correspond to the horizontally polarized waves.

The above-described second embodiment provides the effects described in the first embodiment and the following effects (2a) to (2b).

(2a) The antenna device 40 includes the third first-order resonant antenna 60 in addition to the zeroth-order resonant antenna 20 as an antenna configured to transmit and receive the first linearly polarized wave (the vertically polarized wave in the present embodiment). Accordingly, it is possible to widen the bandwidth of the first linearly polarized radio wave that can be transmitted and received.

(2b) In the present embodiment, the first first-order resonant antenna 70 and the second first-order resonant antenna 80 do not form a double loop structure as in the first-order resonant antenna 30 of the first embodiment but are provided independently. Accordingly, each of the first first-order resonant antenna 70 and the second first-order resonant antenna 80 can be appropriately and easily designed independently. For example, each communication frequency can be easily adjusted.

In the second embodiment, the radiation element 71 of the first first-order resonant antenna 70 may be used as a first radiation element of the present disclosure. The radiation element 81 of the second first-order resonant antenna 80 may be used as a third radiation element of the present disclosure.

3. Other Embodiments

Although the embodiments of the present disclosure have been described above, the present disclosure is not limited to the embodiments described above, and various modifications can be made to implement the present disclosure.

Figure 7:
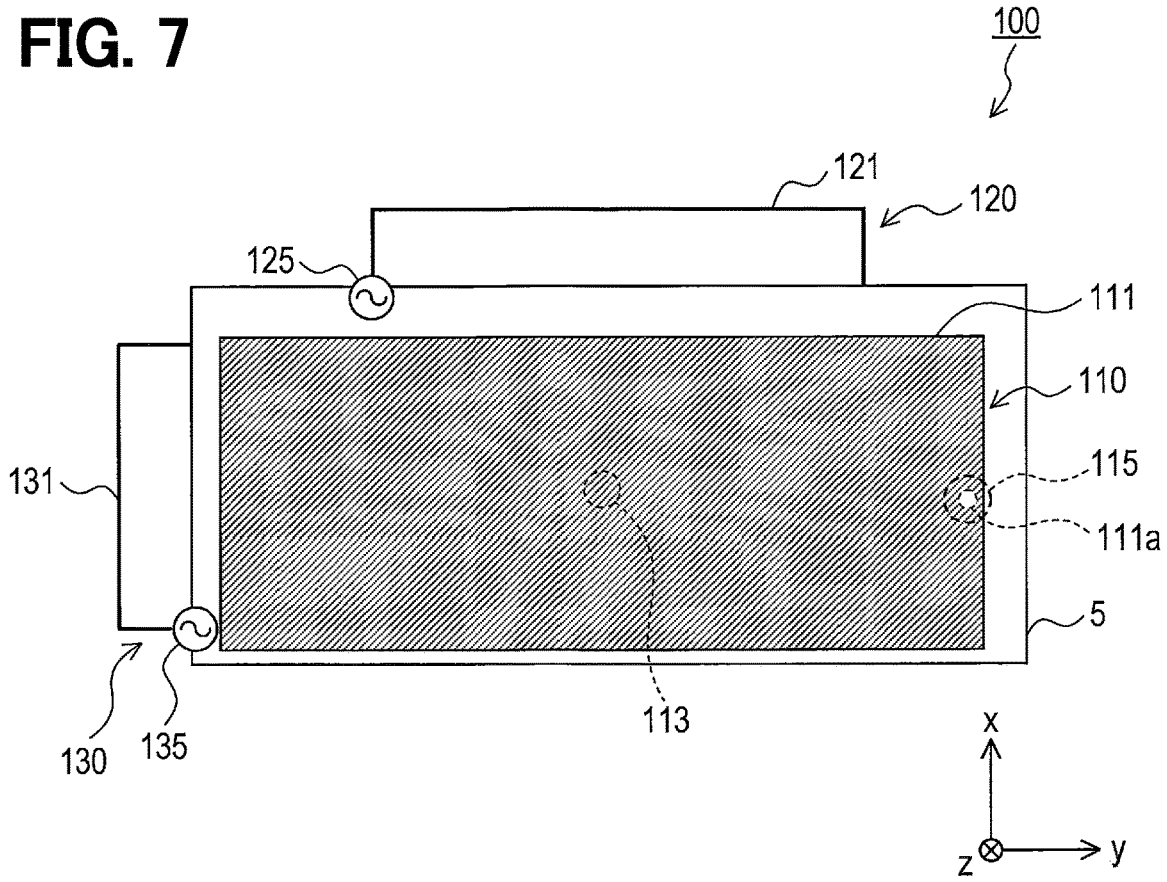
FIG. 7 is a plan view of an antenna device according to another embodiment.

(3-1) In the above embodiments, the platy radiation element 21 of the zeroth-order resonant antenna 20 has a parallelogram shape. However, the platy radiation element of the present disclosure may have any shape. For example, the platy radiation element 111 may have a rectangular shape as shown in FIG. 7, a quadrangle shape different from the rectangular shape, a polygonal shape other than quadrangle shape, or a circular shape. The sides of the platy radiation element may include linear lines and curved lines.

In the first embodiment, the first-order resonant antenna 30 includes two radiation elements. However, the first-order resonant antenna of the present disclosure may include only one first radiation element 121 as the first first-order resonant antenna 120 shown in FIG. 7. Further, the first-order resonant antenna of the present disclosure may include three or more radiation elements.

When three or more radiation elements are provided, triple loop structure may be formed by adding an additional radiation element in a region surrounded by the second radiation element 32 and the base plate 5 of the first-order resonant antenna 30 of the first embodiment.

In the second embodiment, the first first-order resonant antenna 70 and the second first-order resonant antenna 80 are arranged along one of the longer sides of the base plate 5. However, the first-order resonant antennas may be arranged along different sides of the base plate 5.

For example, the first first-order resonant antenna 120 may be arranged along the longer side of the base plate 5, and the second first-order resonant antenna 130 may be arranged along the shorter side of the base plate 5 as shown in FIG. 7. When the first-order resonant antennas are arranged along different sides of the base plate 5, null of the directivity of the first-order resonant antennas can be supplemented each other.

The shape of the first-order resonant antenna is not limited to the U-shape or the loop shape described in the above embodiments. The first-order resonant antenna may have any shape. Further, any number of the first-order resonant antennas may be provided. Three or more first-order resonant antennas may be provided along one side of the base plate 5.

The antenna device 100 shown in FIG. 7 includes the zeroth-order resonant antenna 110, the first first-order resonant antenna 120, and the second first-order resonant antenna 130. The zeroth-order resonant antenna 110 includes the platy radiation element 111 having a quadrangular shape. The platy radiation element 111 and the base plate 5 are connected with each other by the connection conductor 113.

The power supply circuit 115 configured to supply power to the zeroth-order resonant antenna 110 is connected to the base plate 5 and to the feed point 111*a* of the platy radiation element 111. The feed point 111*a* is located at the center portion of the platy radiation element 111 in the y-direction, for example.

The first first-order resonant antenna 120 includes the radiation element 121 having a substantially linear and substantially U-shape. A first end of the radiation element 121 is connected to the base plate 5, and a second end of the radiation element 121 is connected to the power supply circuit 125. That is, the first first-order resonant antenna 120 is different from the first-order resonant antenna 30 of the first embodiment in that the first first-order resonant antenna 120 does not include the first matching circuit 36 and the second matching circuit 37. The first first-order resonant antenna 120 is supplied with power from the power supply circuit 125.

Contrary to FIG. 7, the second end of the radiation element 121 may be connected to the base plate 5, and the power may be supplied to the first end. However, in order to well isolate the feed point of the radiation element 121 from the feed point 111*a* of the zeroth-order resonant antenna 110, it may be preferable that the distance from the feed point of the radiation element 121 to the feed point 111*a* of the zeroth-order resonant antenna 110 is large.

The second first-order resonant antenna 130 includes the radiation element 131 having a substantially linear and substantially U-shape. A first end of the radiation element 131 is connected to the base plate 5, and a second end of the radiation element 121 is connected to the power supply circuit 135.

(3-2) The base plate 5 may be laminated on a dielectric substrate, for example. The shape of the base plate 5 is not limited to the quadrangular shape described in the above embodiments, and may have any shape.

(3-3) The platy radiation element of the zeroth-order resonant antenna may be laminated on a dielectric substrate, for example. In this case, the platy radiation element may face the base plate, or the dielectric substrate may face the base plate.

When the dielectric substrate is laminated on the platy radiation element, a conductive layer may be laminated on a side of the dielectric substrate which is the reverse side of the side on which the platy radiation element is laminated. That is, in the zeroth-order resonant antenna 20 of the first embodiment, for example, the dielectric substrate may be laminated on a side of the platy radiation element 21 which is the reverse side of the side facing the base plate 5, and a conductive layer may be laminated on the dielectric substrate. According to such configuration, the zeroth order resonance frequency f0 of the zeroth-order resonant antenna can be decreased. That is, the same zeroth order resonance frequency f0 can be realized with a platy radiation element having smaller area than a case where the conductive layer is not provided.

(3-4) The connection conductor of the zeroth-order resonant antenna may have a shape different from a circular column shape. For example, the connection conductor may have a prism shape. The connection conductor may have a cylindrical shape. The connection conductor may be connected to any part of the platy radiation element. The platy radiation element and the base plate may be connected by multiple connection conductors.

(3-5) The zeroth-order resonant antenna and the first-order resonant antenna may be dedicated to transmission or reception.

(3-6) The vehicle on which the antenna device is mounted is not limited. The antenna device may be arranged at any part of the vehicle. For example, the antenna device may be arranged on the ceiling in the vicinity of the rear window, or on an upper surface of or inside the instrument panel. The antenna device may be located outside the vehicle, e.g. on the roof.

(3-7) A plurality of functions of one element in the above embodiment may be implemented by a plurality of elements, or one function of one element may be implemented by a plurality of elements. In addition, multiple functions of multiple components may be realized by one component, or a single function realized by multiple components may be realized by one component. A part of the configuration of the above embodiments may be omitted. At least a part of the configuration of the above embodiments may be added to or replaced with another configuration of the above embodiments.

What is claimed is:

1. An antenna device comprising:

a zeroth-order resonant antenna configured to transmit and/or receive a first linearly polarized radio wave in all directions perpendicular to the first linearly polarized radio wave by zeroth order resonance; and a first-order resonant antenna configured to transmit and/or receive a second linearly polarized radio wave perpendicular to the first linearly polarized radio wave by first order resonance, wherein the zeroth-order resonant antenna includes a base plate, a platy radiation element spaced from the base plate, the platy radiation element facing the base plate, the platy radiation element being configured to be supplied with power, and a connection conductor electrically connecting the platy radiation element and the base plate, the first-order resonant antenna includes the base plate shared with the zeroth-order resonant antenna, and a first radiation element located on a same plane as the base plate, the first radiation element being configured to be supplied with power, the first radiation element has a first end connected to the base plate, and a second end configured to be supplied with power, the first radiation element and the base plate of the first-order resonant antenna form a first closed loop, the first order resonant antenna includes a second radiation element located inside the first closed loop, the second radiation element has a first end connected to the base plate, and a second end configured to be supplied with power, and the second radiation element and the base plate of the first-order resonant antenna form a second closed loop.

2. The antenna device according to claim 1, wherein a part or whole of the first radiation element does not overlap the platy radiation element in a direction perpendicular to the base plate.

3. The antenna device according to claim 1, wherein the platy radiation element has a polygonal shape having at least one acute internal angle and at least one obtuse angle, a part of the platy radiation element located in a vicinity of a vertex corresponding to the at least one obtuse angle is configured to be supplied with power.

4. The antenna device according to claim 1, wherein the first-order resonant antenna is a first first-order resonant antenna, the antenna device further comprises:

a second first-order resonant antenna different from the first first-order resonant antenna, wherein the second first-order resonant antenna is configured to transmit and/or receive a third linearly polarized radio wave perpendicular to the first linearly polarized radio wave by first order resonance, the second first-order resonant antenna includes the base plate shared with the zeroth-order resonant antenna, and a third radiation element located on the same plane as the base plate, the third radiation element being configured to be supplied with power.

5. The antenna device according to claim 1, wherein the first-order resonant antenna is a first first-order resonant antenna, the antenna device further comprises:

a third first-order resonant antenna different from the first first-order resonant antenna, wherein the third first-order resonant antenna includes the base plate shared with the zeroth-order resonant antenna, and the third first-order resonant antenna is configured to transmit and/or receive the first linearly polarized radio wave by first order resonance.

6. The antenna device according to claim 1, further comprising:

a hollow casing that has a side face portion including a platy conductor, wherein the base plate is located outside the casing and on the side face portion, and the base plate is connected to the platy conductor of the side face portion.

7. The antenna device according to claim 1, wherein the antenna device is mounted on a vehicle, the first linearly polarized radio wave is a vertically polarized wave, and the second linearly polarized radio wave is a horizontally polarized wave.

8. The antenna device according to claim 1, wherein the antenna device is mounted on a vehicle such that the first radiation element is located on a front side of the vehicle with respect to the base plate.

* * * * *